US007717260B2

(12) United States Patent
Buse

(10) Patent No.: US 7,717,260 B2
(45) Date of Patent: May 18, 2010

(54) HINGED LID BOX FOR CIGARETTES

(75) Inventor: Henry Buse, Visselhövede (DE)

(73) Assignee: Focke & Co. (GmbH & Co. KG), Verden (DE)

( * ) Notice: Subject to any disclaimer, the term of this patent is extended or adjusted under 35 U.S.C. 154(b) by 80 days.

(21) Appl. No.: 11/577,836

(22) PCT Filed: Sep. 23, 2005

(86) PCT No.: PCT/EP2005/010292

§ 371 (c)(1),
(2), (4) Date: Apr. 24, 2007

(87) PCT Pub. No.: WO2006/045385

PCT Pub. Date: May 4, 2006

(65) Prior Publication Data

US 2008/0121538 A1 May 29, 2008

(30) Foreign Application Priority Data

Oct. 25, 2004 (DE) ..... 10 2004 051 981

(51) Int. Cl.
*B65D 85/10* (2006.01)

(52) U.S. Cl. ..... 206/268; 206/273; 206/265; 206/242; 229/160.1

(58) Field of Classification Search ..... 206/268, 206/248, 256, 257, 271, 265, 273, 85, 86, 206/87, 258; 229/160.1, 87.13
See application file for complete search history.

(56) References Cited

U.S. PATENT DOCUMENTS

| | | | | |
|---|---|---|---|---|
| 4,216,898 | A * | 8/1980 | Davies | 229/160.1 |
| 4,303,155 | A * | 12/1981 | Focke et al. | 206/264 |
| 4,850,482 | A * | 7/1989 | Campbell | 206/273 |
| 4,895,251 | A * | 1/1990 | Focke et al. | 206/273 |
| 5,129,513 | A * | 7/1992 | David et al. | 206/265 |
| 5,150,720 | A * | 9/1992 | Focke et al. | 131/329 |
| 5,158,664 | A * | 10/1992 | Colgan et al. | 206/242 |
| 5,314,062 | A * | 5/1994 | Wu et al. | 206/268 |
| 5,439,105 | A * | 8/1995 | Focke | 206/268 |
| 5,570,779 | A * | 11/1996 | Draucker et al. | 206/246 |
| 5,819,925 | A * | 10/1998 | Brizzi et al. | 206/268 |
| 6,457,580 | B1 * | 10/2002 | Focke et al. | 206/259 |
| 2003/0029746 | A1 * | 2/2003 | Draghetti et al. | 206/268 |

FOREIGN PATENT DOCUMENTS

| | | |
|---|---|---|
| DE | 71 19 018 U | 5/1971 |
| DE | 23 01 984 A1 | 7/1974 |
| DE | 42 00 719 A1 | 8/1992 |
| EP | 801 011 A1 | 3/1997 |
| EP | 1 279 619 A2 | 1/2003 |
| GB | 522469 | 9/1939 |

* cited by examiner

*Primary Examiner*—Mickey Yu
*Assistant Examiner*—Chun Cheung
(74) *Attorney, Agent, or Firm*—Sughrue Mion, PLLC

(57) ABSTRACT

In a hinge-lid box comprising a box part (13), lid and collar (15), the collar (15) is configured such that the collar side tabs (29, 30) lie at a distance from the box side walls (26). The collar side tabs (29, 30) are supported by supporting tabs (35, 36; 40, 41) on the box side walls (26).

5 Claims, 3 Drawing Sheets

14
45
21
27
12
29
33
15
31
28
39
13
16
39
26
42
33
30
19
41
27
44
20

VI
V
14
20
21
27
VI
35
29
V
40
15
26
39
16
28
13

Fig.5
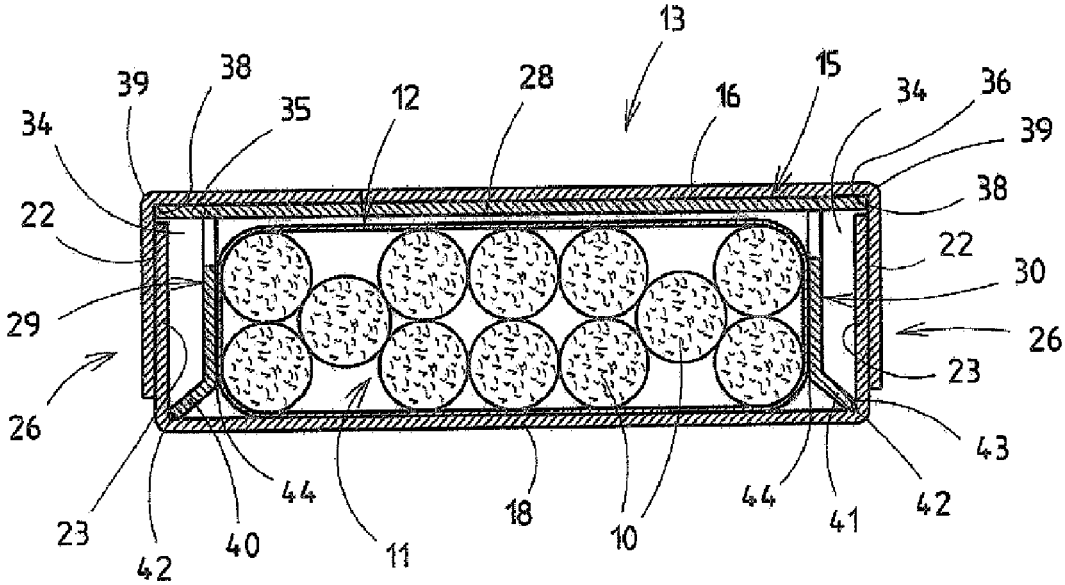
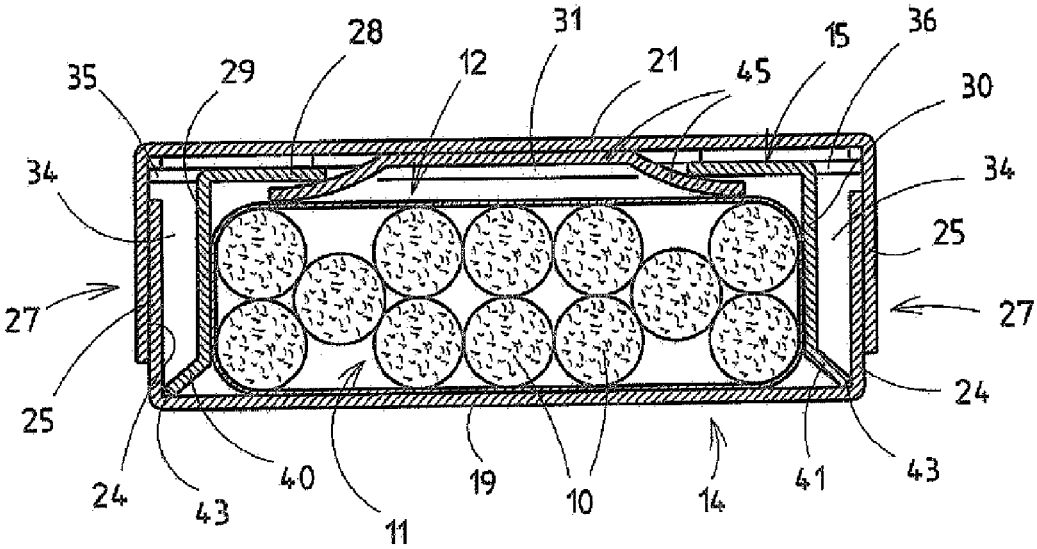
Fig.6

HINGED LID BOX FOR CIGARETTES

BACKGROUND OF THE INVENTION

The invention relates a hinge-lid box with box part, lid and collar, in particular for a cigarette group as its contents, with the collar, which is affixed in the box part, having a collar front wall and collar side tabs that face a box front wall and box side walls, respectively.

Hinge-lid boxes are the most widely distributed kind of cigarette packs worldwide. The design layout of this type of pack is defined by a (lower) box part, a lid and a collar, the latter usually being made from a separate blank. The lid is connected to the box part by means of a transverse hinge line in the region of the box rear wall and lid rear wall. The collar is affixed in the box part such that the collar front wall lies against the box front wall and the collar side tabs lie against the box side walls. The pack contents is a cigarette block, i.e. an arranged group of cigarettes, which fills out the inner space of the hinge-lid box and which is surrounded by an inner liner of paper or tin foil.

SUMMARY OF THE INVENTION

The object of the invention is to propose a new shape for the hinge-lid box for in particular cigarettes which ensures an improved fit between the pack and the pack contents, in particular a shape that conforms to varying dimensions of the pack contents.

To achieve this object, the hinge-lid box according to the invention is characterized by the following features:

a) the collar side tabs are disposed at a distance from the box side walls, b) the collar side tabs are supported at the inner side of the box side wall by means of supporting tabs disposed at the edges of said collar side tabs.

The pack contents—cigarette block—is surrounded by a collar having a U-shaped cross section. According to the invention, a special design and positioning of the collar creates a an interior space available to the pack contents that is reduced with respect to the outer dimensions of the hinge-lid box. The side tabs of the collar are disposed at a distance from the box side walls and supported on them at the front and rear sides of the box.

Particularly advantageous is an embodiment in which a front supporting tab is formed by means of, in particular, a U-shaped punched cut as a subregion of the collar side tab and which extends in the plane of the collar front wall. Rear supporting tabs are formed by bending an edge strip of the collar side tab, in particular in an oblique position in which a free edge of the supporting tab enters a centered position at an upright rear corner of the pack.

In the hinge-lid box according to the invention the cigarette block has a smaller width than the hinge-lid box. In particular, an upright hollow space is created at either side of the cigarette block which can also be employed to accommodate pack inserts, such as printed matter.

BRIEF DESCRIPTION OF THE DRAWINGS

Further special features of the invention will be discussed in more detail below with the help of an exemplary embodiment illustrated in the corresponding drawing which shows.

DETAILED DESCRIPTION

Figure 2:
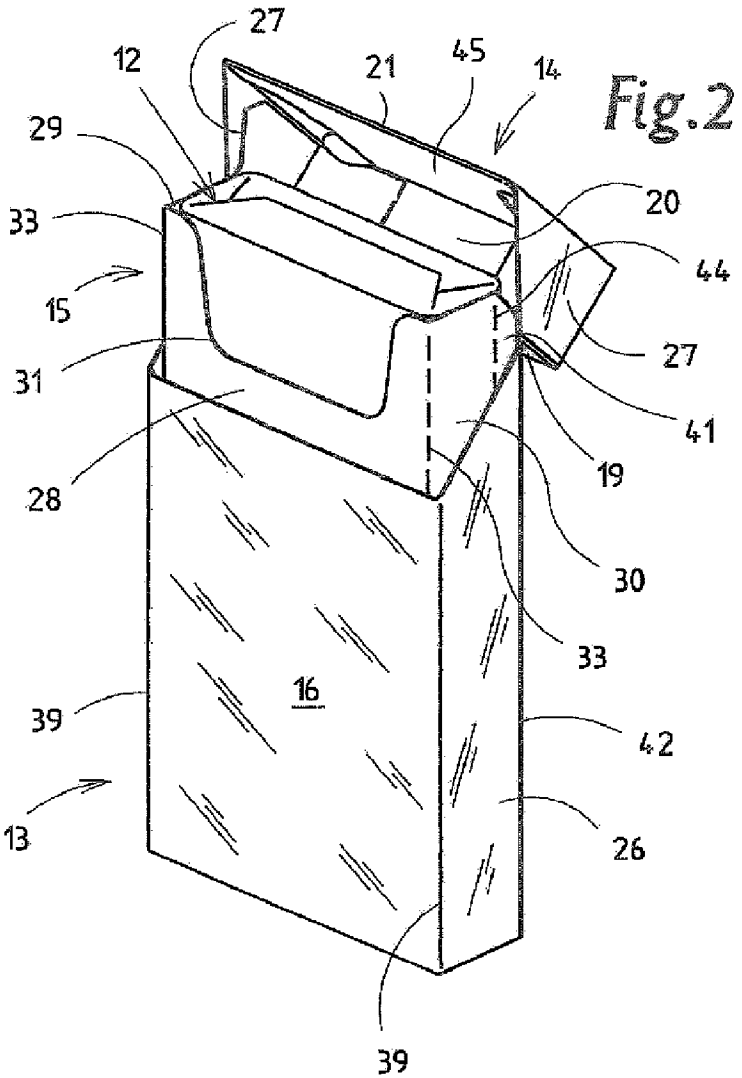
FIG. 2 the hinge-lid box from FIG. 1 with open lid, also in perspective view, FIG. 3 a spread-out blank for a hinge-lid box pursuant to FIG. 1, FIG. 2, FIG. 4 a likewise spread-out blank of a collar for a hinge-lid box pursuant to FIG. 1, FIG. 2, FIG. 5 horizontal section of the hinge-lid box of FIG. 1 along section plane V-V, on an enlarged scale, FIG. 6 view analogous to FIG. 5 in the region of section plane VI-VI of FIG. 1.

The exemplary embodiment shown in the drawings relates to a hinge-lid box for cigarettes 10. A cigarette group 11 is surrounded by an inner liner, thus forming an approximately cuboid cigarette block 12 as the pack contents.

Figure 3:
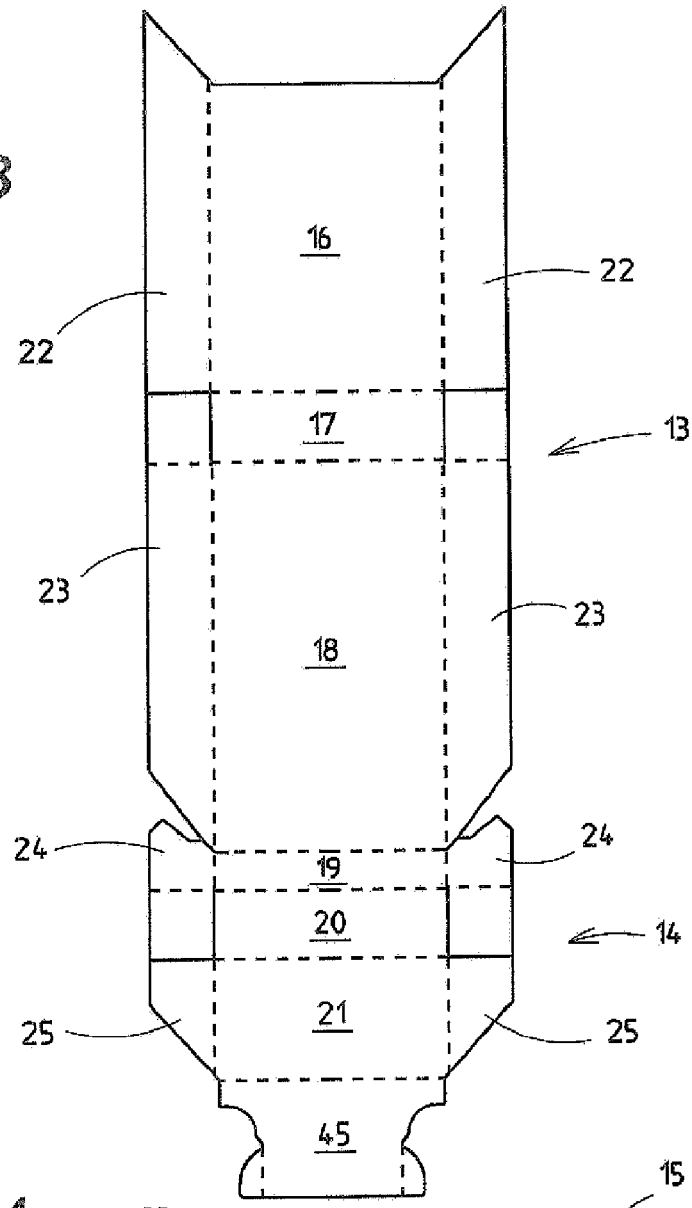
Figure 4:
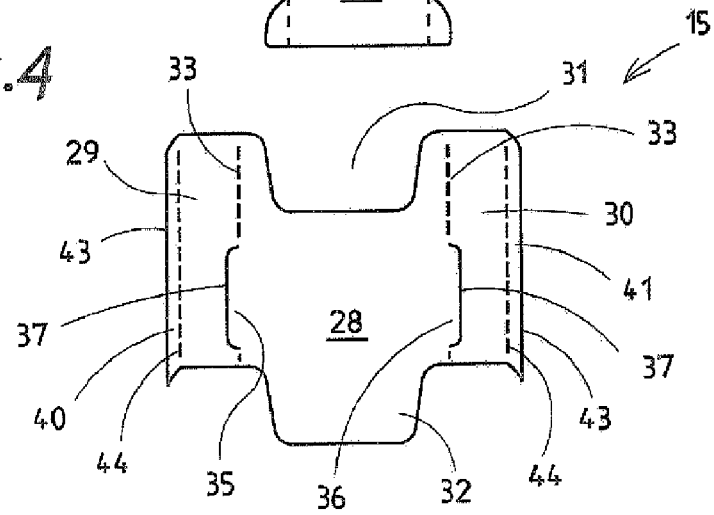

The hinge-lid box comprises a (lower) box part 13, a lid 14 and a collar 15. Box part 13 and lid 14 comprise a common, one-piece blank pursuant to FIG. 3. This forms, by means of appropriately pre-embossed folding lines, a box front wall 16, a base wall 17, a box rear wall 18, a lid rear wall 19, an end wall 20 and a lid front wall 21. Attached to the aforementioned pack walls and regions of the blank are box side tabs 22, 23 and lid side tabs 24, 25. These partially overlap one another to form box side walls 26 and lid side walls 27.

The collar 15 comprises collar front wall 28 and collar side tabs 29, 30. At its top side the collar front wall forms a generally common recess 31. Formed at the opposite side is a tongue 32 of the same shape and size.

Collar front wall 28, on one hand, and collar side tabs 29, 30, on the other hand, are delimited from each other by upright folding lines 33. These are formed by modifying the material of the collar, in particular by embossing or, as shown, by a series of punched cuts. After the collar is folded in a U shape, such measures result in sharp, upright collar edges in the region of these folding lines 33.

The folded collar 15 surrounds the cigarette block 12 such that the collar front wall abuts a front side and the collar side tabs 29, 30 each abut the narrow side faces of the cigarette block 12 (FIG. 5, FIG. 6). The collar is affixed to the box part 13, in particular by adhesive bonding such that an upper limit of the collar 15 is essentially flush with the cigarette block 12.

The pack contents, namely the cigarette block 12, is configured to have a smaller width than the (outer) dimensions of the hinge-lid box. For conforming to the dimensions of the cigarette block 12 the collar side tabs 29, 30 are positioned at a distance from the inner side of the side walls and parallel thereto. When the collar is symmetrically arranged and configured with respect to both sides, this results in an upright hollow space 34 between the side walls 26, 27, on one hand, and the collar side tabs 29, 30, on the other. The hollow space can be used to accommodate pack inserts, in particular to hold (folded) printed information, advertisements, etc.

The collar 15 is aligned and supported within the hinge-lid box. On its front side, namely adjacent to the box front wall 16, the collar 15 has laterally directed supporting tabs 35, 36. These are formed by the collar 15 itself, specifically by a U- or C-shaped punched cut 37. This is disposed at a specific position relative to the folding line 33, namely such that supporting tabs 35, 36 are formed to extend essentially in the region of the collar side tabs 29, 30. Curved legs of the punched cut 37 end at the extension of the folding line 33. The result of this is that, when the collar side tabs 29, 30 are folded around in a U-shape manner, the supporting tabs 35, 36 remain in their original position, namely aligned in the plane of the collar front wall 28, and thus automatically assume the supporting position as shown in FIG. 5. The dimension of the punched cut 37 and thus that of the supporting tabs 35, 36 is selected so that the supporting edges 38 reinforce at the box side wall 26, specifically in an upright gap between the inner box side tab 23 and the box front wall 16. Here, the hinge-lid box or the box part 13 forms an upright front corner 39.

Figure 1:
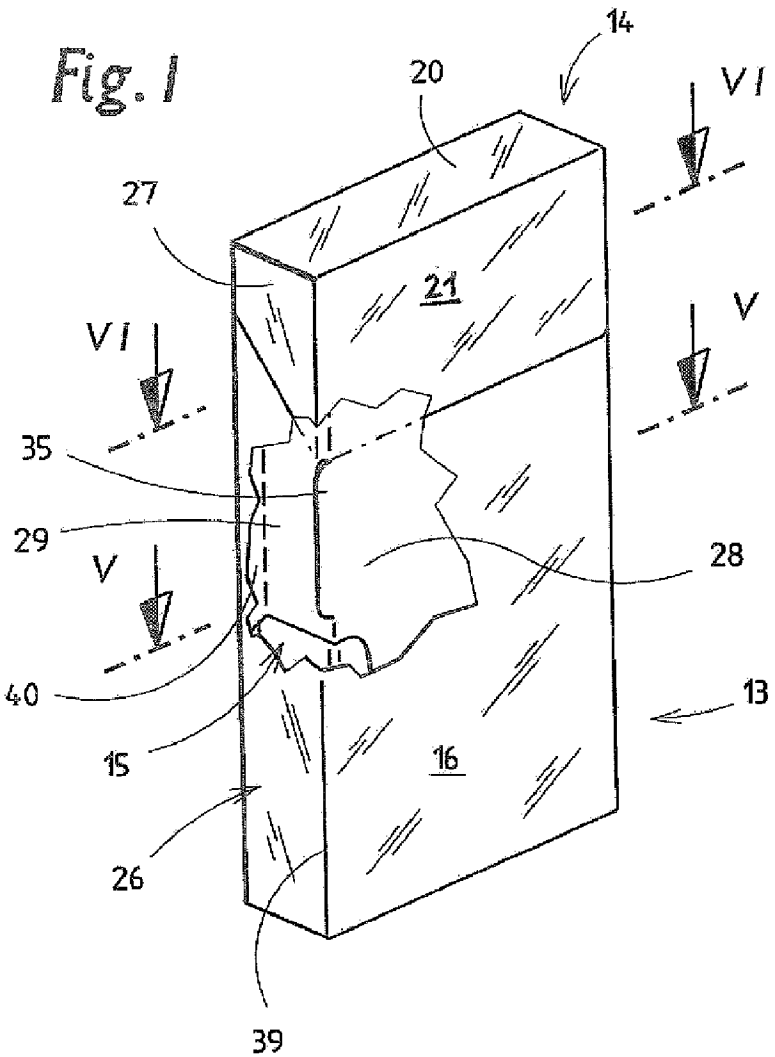
FIG. 1 the front side of a closed hinge-lid box in perspective view.

One special feature is that the punch cut 37 is arranged in a lower region of the collar 15 such that the supporting tab 35, 36 is preferably completely covered by the box front wall 16, i.e. that it ends below an upper edge of said front wall 16 (FIG. 1).

The collar 15 is also aligned within the hinge-lid box at its back side. Here, too, collar side tabs 29, 30 form supporting tabs, namely edge tabs 40, 41. A supporting edge 43 of the edge tabs 40, 41 enters a rear pack corner 42 (FIG. 5, FIG. 6). The edge flaps 40, 41 serving as supporting means are directed obliquely, in particular at an angle of (approximately) 450. For this purpose, each of the collar side tabs 29, 30 is provided with an additional folding line 44, created in particular by punching. This line defines the edge tabs 40, 41 such that the latter assume their obliquely aligned supporting position when the collar 15 is correspondingly folded. The collar 15 therefore assumes an overall stable position within the hinge-lid box, specifically without the collar side tabs 29, 30 abutting the side walls of the box with their full surface.

By virtue of its illustrated and described design, the collar 15 can conform to varying dimensions of the pack contents with the prescribed outer dimensions. In the exemplary embodiment shown (FIG. 5, FIG. 6), a cigarette group 11 with twelve cigarettes 10 is provided. These are positioned in a special formation, namely with eight cigarettes adjacent to one another in pairs, with two individual cigarettes each centrally positioned in the respective "cradle position". The latter are supported at either side by two adjacent cigarettes.

The design or arrangement of the collar 15 can also be chosen such that the cigarette block 12 is arranged in an off-center and offset position within the hinge-lid box, to the extreme point where a hollow space 34 is formed on only one side.

The hinge-lid box is provided with the commonly known opening aid, by means of which a lid inner tab 45, due to the special contour of its side edges (FIG. 3), latches with the collar front wall 28 in the closed position, specifically in a region adjacent to the recess 31. The lid inner tab is configured with a reduced width in this region to conform to the smaller width of the collar front wall 28.

LIST OF DESIGNATIONS

10 cigarette
11 cigarette group
12 cigarette block
13 box part
14 lid
15 collar
16 box front wall
17 base wall
18 box rear wall
19 lid rear wall
20 end wall
21 lid front wall
22 box side tab
23 box side tab
24 lid side tab
25 lid side tab
26 box side wall
27 lid side wall
28 collar front wall
29 collar side tab
30 collar side tab
31 recess
32 tongue
33 folding line
34 hollow space
35 supporting tab
36 supporting tab
37 punched cut
38 supporting edge
39 front corner
40 edge tab
41 edge tab
42 pack corner
43 supporting edge
44 folding line
45 lid inner tab

The invention claimed is:

1. A hinge-lid box for a cigarette block (12) as pack contents, having a box part (13), a lid (14) and a collar (15), which is affixed in the box part (13), and a collar front wall (28) and collar side tabs (29, 30) that face a box front wall (16) and box side walls (26), respectively, with supporting tabs (35, 36) being formed by a C- or U-shaped punched cut (37) in a region of a collar front wall (16) adjacent to the collar side tabs (29, 30) in such a manner that the supporting tabs (35, 36) extend in a plane of the collar front wall (28) to abut against a box side wall (26), characterized by the following features:

a) the collar side tabs (29, 30) are disposed at a distance from the box side walls (26) and—when the lid is closed—at a distance from lid side walls (27) and run parallel to said lid side walls (26, 27), b) the collar side tabs (29, 30) are supported by two support elements of the collar (15) at the box side walls (26), namely in a front region of the hinge-lid box by front supporting tabs (35, 36) and in a rear region by an edge tab (40, 41), which is formed on each of the collar side tabs (29, 30) and which is directed at an obtuse angle to the collar side tabs (29, 30) such that the edge tab (40, 41) is supported by a respective supporting edge (43) in a rear pack corner.

2. The hinge-lid box according to claim 1, characterized by the following features:

a) the box side walls (26) of the box part (13) comprise overlapping and mutually connected outer box side tabs (22) and inner box side tabs (23), b) the box side tabs (22, 23) are disposed such that an upright gap is formed in a region of a front corner (39) of a box front wall (16) and a box side wall (26) and delimited at its inner side by a free edge of an inside box side tab (23), and c) the front supporting tabs (35, 36) of the collar (15) enter, with marginal regions thereof, the upright gap.

3. The hinge-lid box according to claim 1, characterized in that the front supporting tabs (35, 36) are arranged completely inside the box part (13).

4. The hinge-lid box according to claim 2, characterized in that the front supporting tabs (35, 36) are arranged completely inside the box part (13).

5. A hinge-lid box for a cigarette block (12) as pack contents, having a box part (13), a lid (14) and a collar (15), which is affixed in the box part (13), and a collar front wall (28) and collar side tabs (29, 30) that face a box front wall (16) and box side walls (26), respectively, with front supporting tabs (35, 36) being formed by a C- or U-shaped punched cut (37) in a region of the collar front wall (28) adjacent to the collar side tabs (29, 30) in such a manner that the front supporting tabs (35, 36) extend in a plane of the collar front wall (28) to abut against a box side wall (26), characterized by the following features:

a) the collar side tabs (29, 30) are disposed at a distance from and parallel to the box side walls (26) of the box part (13) and parallel to lid side walls (27) of the lid (14), b) the collar side tabs (29, 30)—except for those supported by the front supporting tabs (35, 36) —are supported in a rear region of the box part (13) by an edge tab (40, 41), arranged on each of the collar side tabs (29, 30), with a supporting edge (43) in a rear pack corner (42) of the box part (13), and c) the edge tabs (40, 41) are formed by folding lines (44) at a free edge of the collar side tabs (29, 30) and supported at an approximately 45° angle in the respective rear pack corner (42).

* * * * *